US007834899B2

(12) United States Patent
Hyde et al.

(10) Patent No.: US 7,834,899 B2
(45) Date of Patent: Nov. 16, 2010

(54) LASER MARKING SYSTEM

(75) Inventors: Samuel C. Hyde, Cambridge (GB); Neil Griffin, Cambridge (GB)

(73) Assignee: The Technology Partnership PLC, Melbourn (GB)

( * ) Notice: Subject to any disclaimer, the term of this patent is extended or adjusted under 35 U.S.C. 154(b) by 381 days.

(21) Appl. No.: 10/579,565

(22) PCT Filed: Nov. 15, 2004

(86) PCT No.: PCT/GB2004/004808

§ 371 (c)(1), (2), (4) Date: May 12, 2006

(87) PCT Pub. No.: WO2005/049332

PCT Pub. Date: Jun. 2, 2005

(65) Prior Publication Data

US 2008/0192107 A1 Aug. 14, 2008

(30) Foreign Application Priority Data

Nov. 14, 2003 (GB) ..... 0326597.2

(51) Int. Cl.
*B41J 2/45* (2006.01)

(52) U.S. Cl. ..... 347/238

(58) Field of Classification Search ..... 347/185–187, 347/224, 233–234, 244, 248, 237–240, 247, 347/251–254; 430/327, 330, 349
See application file for complete search history.

(56) References Cited

U.S. PATENT DOCUMENTS 4,383,261 A * 5/1983 Goldberg ..... 347/224
5,389,959 A * 2/1995 Haas ..... 347/187
5,557,303 A 9/1996 Agano et al.
5,612,198 A 3/1997 Brierley et al.
5,615,198 A 3/1997 Kubokawa
5,909,232 A * 6/1999 Goto et al. ..... 347/187
6,633,319 B1 * 10/2003 Yamakawa et al. ..... 347/172
6,670,978 B2 * 12/2003 Sasaki ..... 347/233
6,989,854 B1 * 1/2006 Figov et al. ..... 347/244
7,256,803 B2 * 8/2007 Hilbert ..... 347/171

FOREIGN PATENT DOCUMENTS

| | | |
|---|---|---|
| EP | 0818 308 A1 | 1/1998 |
| JP | 05-024219 | 2/1993 |
| JP | 07-052419 | 2/1995 |
| JP | 07-061038 | 3/1995 |
| JP | 09-314970 | 12/1997 |
| JP | 2003-080745 | 3/2003 |
| JP | 2003-114398 | 4/2003 |

* cited by examiner

*Primary Examiner*—Hai C Pham
(74) *Attorney, Agent, or Firm*—Knobbe Martens Olson & Bear LLP

(57) ABSTRACT

A laser marking system comprises means for transmitting the laser-emitted light onto one or a plurality of points on a substrate, with means for displacing the substrate and laser light emitting source relative to one another, wherein the substrate is selected to be sufficiently sensitive to the emitted light so that a reaction occurs at either said point or plurality of points which marks the substrate and characterised by the feature that the laser light emitting source comprises an array of lasers.

17 Claims, 2 Drawing Sheets

LASER MARKING SYSTEM

FIELD OF THE INVENTION

The invention relates to laser marking systems.

Prior Art Known to the Applicants

U.S. Pat. No. 6,075,223, discloses a prior art method of laser marking for metal, plastics, ceramics substrates using sensitive inks (one prior art example of sensitive inks being microencapsulated inks). This prior art document was selected as useful background to the present invention because it teaches the use of a single laser energy source adapted to emit a wavelength which in this prior art document is destined to be absorbed by the ink to create a bond between the ink and the substrate at the irradiated points.

Other prior art examples of single laser marking systems are used on paper-based substrates. The applications of this technology have taken place primarily for date and lot coding on production lines. In one particular application (EP 0 782 933—Nippon Kayaku) a single laser is used in combination with a special substrate containing both paper and a colour-forming reaction material. In this prior art application, the laser supplies sufficient energy to cause the paper to be visibly marked.

Prior art laser marking systems broadly have the following drawbacks:

- The commonly used $CO_2$ laser systems, disclosed and recommended in the prior art, are limited by their size and can therefore not easily be scaled down to provide a compact source;
- Arrays of $CO_2$ cannot be created and require an additional scanning system to scan the laser beam in order to create a 2D image;
- They are also complex systems with a high unit cost;
- One main drawback of these prior art systems is their relatively slow achievable speed of marking;
- Another prior art drawback is their relatively high power consumption.

The objectives of the present invention include introducing a system which offers significant advantages over this prior art teaching, by reducing the overall cost of marking systems, making a more compact and serviceable system, enhancing the speed of printing, reducing the individual laser power requirement and reducing the overall cost of marking by reducing the unitary cost of the substrate required to be employed by the system.

Another objective of the present invention is to propose alternative solutions to the drawbacks and problems associated with the prior art discussed above, all forming part of the single inventive concept of 'improvements to laser marking systems transmitting light onto one or a plurality of points on a sensitive substrate'.

SUMMARY OF THE INVENTION

In a first broad independent aspect, the invention provides a laser marking system comprising means for transmitting the laser-emitted light onto one or a plurality of points on a substrate, with means for displacing the substrate and laser light emitting source relative to one another, wherein the substrate is selected to be sufficiently sensitive to the emitted light so that a reaction occurs at either said point or plurality of points which marks the substrate and characterised by the feature that the laser light emitting source comprises an array of lasers.

This configuration is advantageous because it achieves greater compactness, has greater reliability, is more serviceable whilst utilising lower levels of power and achieving higher speed of marking and being altogether low cost. It is particularly advantageous because the use of a laser array may achieve simultaneous multiple point marking. This will contribute to reducing the time required to mark the substrate. In this configuration, each laser may also be individually addressed which may allow different levels of pigmentation marking for different pixels to be substantially simultaneously marked onto the substrate. Furthermore, the paper costs may be kept to a minimum.

In a second broad independent aspect, the invention provides a laser marking system, comprising an array of lasers, which in use, emit light, means for transmitting the emitted light onto one or a plurality of points on a substrate, means for displacing the substrate and said array relative to one another, and a heater whose primary function is to heat the substrate prior to radiating the substrate so that the energy required to be supplied by the array of lasers for marking the substrate is minimised.

This configuration will be particularly beneficial because it will have the effect of reducing the necessary laser power required to cause a reaction on the substrate during the marking process. One specific benefit of this configuration is that it allows relatively low sensitivity paper substrate to be marked with relatively low power lasers, thus reducing the paper and system costs. A further advantage of this configuration is that it will allow enhanced marking speeds to be achieved in certain applications.

In a subsidiary aspect in accordance with the invention's second broadest aspect, the heater employs a heat exchanger for transferring the heat generated by the array of lasers to the substrate.

This configuration is particularly energy efficient as it simultaneously goes towards solving any problems of overheating of the laser array and of pre-heating the substrate before radiation. This configuration may also be particularly cost effective.

In a further subsidiary aspect in accordance with the invention's second broadest aspect, the heater is a light emitter.

Utilising a light emitter as a heater has the particular benefit of requiring little or no start-up heating time and therefore a laser marking system incorporating such a feature will have particular benefits in applications where the use is sporadic rather than continuous.

In a third broad independent aspect, the invention provides a laser marking system, comprising an array of lasers, which in use, emit light, means for transmitting the emitted light onto one or a plurality of points on a substrate, means for displacing the substrate and said array relative to one another, and a further light emitter positioned relative to the laser array and adapted to supply sufficient light in order to bring the substrate close to the marking threshold so that as the array of lasers radiates, the marking threshold is passed due to the combined effect of the laser array and the further light emitter.

This configuration is particularly advantageous when the substrate is marked by photo-chemical reactions as the light is used to bring the substrate close to the marking threshold having the effect of significantly reducing the required laser power for achieving marking.

In a subsidiary aspect in accordance with the third broad aspect, the light emitter radiates the substrate at a point substantially coincident with the point of laser radiation.

In a subsidiary aspect in accordance with any of the broad independent aspects of the invention, the system comprises lasers which emit light in the infra red or near infra red spectrum and the substrate is selected to be sensitive to infra red or near infra red radiation.

When the lasers and the substrate are of this kind, the advantages outlined above with regard to the preceding aspects are significantly enhanced.

In a further subsidiary aspect in accordance with any of the broad independent aspects, the system further comprises means for varying the energy supplied to each point of the substrate by varying over time the pulse and/or amplitude of the transmitted light so that a scale of mark's pigmentation may be achieved.

This configuration has particular benefits for achieving so-called grey-scale markings on substrates.

In a further subsidiary aspect, one or more optical elements are located between the laser and/or lasers and the substrate. This would allow the lasers to be appropriately spaced from the substrate and the radiation to be controlled in terms of shape.

In a further subsidiary aspect, said one or more optical elements incorporate a single bulk lens and/or an array of micro lenses and/or a wave guide and/or a graded-index lens and/or a diffractive optical element and/or a reflector. The incorporation of a single bulk lens would have particular advantages in terms of tolerances. The incorporation of an array of micro lenses would allow a light and compact arrangement to be achieved. The incorporation of a wave guide would have advantages over a microlens array in terms of tolerance and in terms of potential for shaping. The incorporation of a graded-index lens would also have particular advantages in terms of tolerances. The incorporation of a diffractive element would have particular advantages in terms of shaping. The incorporation of a reflector would have particular advantages in terms of its ability to change the direction of radiation.

In a further subsidiary aspect, the system incorporates a plurality of radiation outputs and means for switching the path of radiation to selected outputs. This would allow a reduced number of laser elements to be used.

In a further subsidiary aspect, the system incorporates means for directing the radiation in a plurality of directions. This would also allow a reduced number of laser elements to be used.

In a further subsidiary aspect, the system incorporates mechanically displaceable optical elements and/or electronically switchable diffractive elements and/or branched wave guides.

In a further subsidiary aspect, the or each laser is pulsed temporally. This would allow more efficient marking to be achieved.

DETAILED DESCRIPTION OF THE FIGURES

The term 'heat exchanger' employed in this application is destined to be interpreted broadly for example by including within its scope passive heat exchangers and active heat exchangers such as heat pumps.

Figure 1:
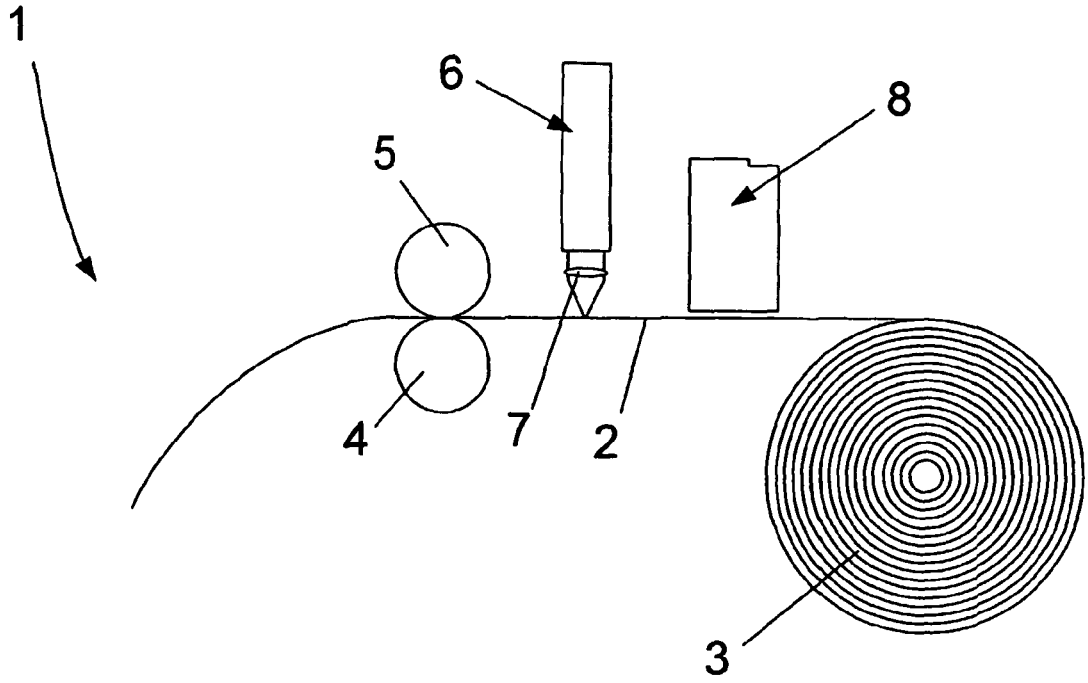
FIG. 1 shows schematically a side elevation of a laser marking system in accordance with a first embodiment of the invention.

FIG. 1 shows a laser marking system generally referenced 1. Laser marking system 1 comprises a substrate 2 drawn from a roll 3 by a pair of drive wheels 4 and 5. Substrate 2 is located immediately beneath a laser array 6 incorporating a number of individually addressed elements (not specifically illustrated in the figure). The light emitted by the laser array 6 is transmitted to substrate 2 via a lens 7 spaced between the laser array and the substrate in order to focus the light transmitted onto a point on the substrate.

Upstream from the laser array 6, there is provided a pre-heating bar 8 located in proximity to the substrate in order to transfer thermal or optical energy to the substrate so that as the substrate approaches the laser array it is close to its marking threshold. The geometry of the pre-heating bar may be designed to cover the width of the substrate. The pre-heating bar may take a variety of forms such as a resistive heater incorporating heating elements operating by conduction or radiation, or optical sources heating by absorption of optical radiation.

The heating characteristics of the bar may also be tailored to particular applications, for example by providing higher or lower heating energy where greater heat loss is predicted at certain points of the substrate due to the substrate's position in the system, its environment, its geometry and/or its material characteristics.

Laser array 6 may be selected by the person skilled in the art from known alternatives which may include semi-conductor laser diode arrays. The energy in the laser light will be selected so that when absorbed by the paper it causes a chemical reaction which results in a mark.

It is also envisaged that the laser array may incorporate only a reduced number of laser elements associated with means for controlling the lateral position on a substrate that the laser spot is focused onto. This may be achieved, for example, by mechanical motion of optical elements, by electronically switchable diffractive elements or by branched wave guides with switching components (such as Mach-Zehnder Interferometers).

The optical transmission means referred to above as 7 may comprise a single lens or a more complex array of micro lenses, wave guides, graded-index lenses, diffractive optical elements or even reflectors.

The substrate may be selected by the person skilled in the art to be a paper or other sheet forms such as synthetic paper or resin films which react to laser light: primarily optically, primarily chemically or photo-chemically, and/or thermally including thermal initiation and/or any combination and/or sequence of these reactions. In one preferred form it is envisaged that the paper and the laser will be respectively selected to radiate in the infra red spectrum and react chemically or optically in the infra red spectrum.

Figure 2:
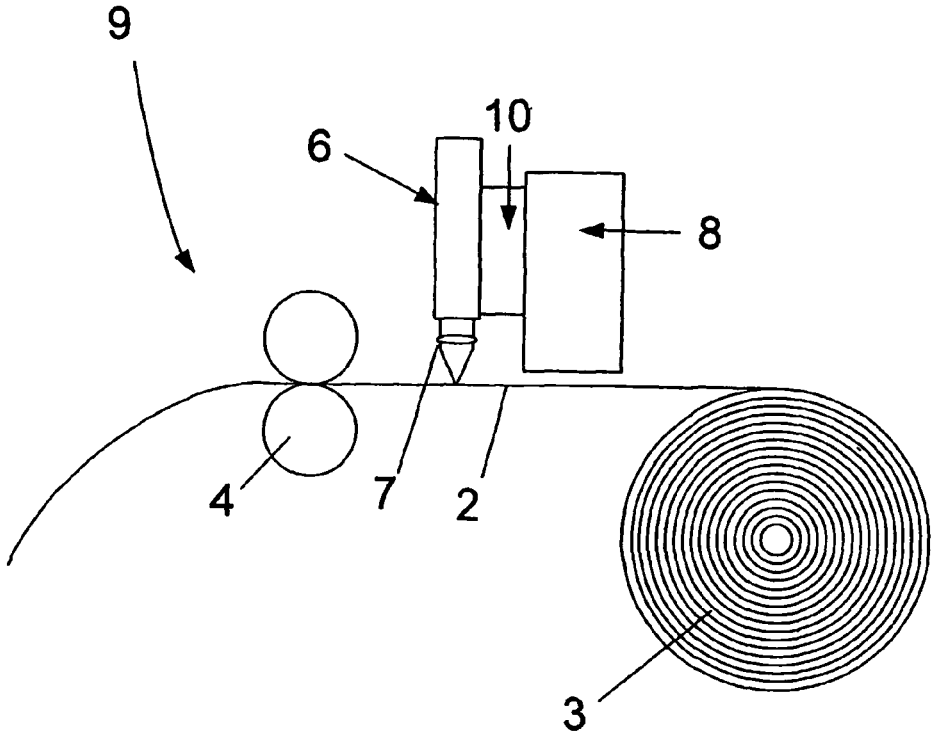
FIG. 2 is a schematic representation in side elevation of a laser marking system in accordance with a second embodiment of the invention.

FIG. 2 shows a laser marking system generally referenced 9 where, for simplicity, components which are similar to those employed in the illustration of FIG. 1 have retained the same numerical references. The primary addition to the configuration presented in FIG. 1 is the addition of a heat pump 10 which allows the heat exchange between laser array 6 and pre-heater 8. In a similar fashion, other waste heat in the system say from the drive electronics may be used in the pre-heater. The person skilled in the art may, for example, select a thermo-electric device as a heat pump placed between the laser and the pre-heater to improve the heat transfer efficiency.

Figure 3:
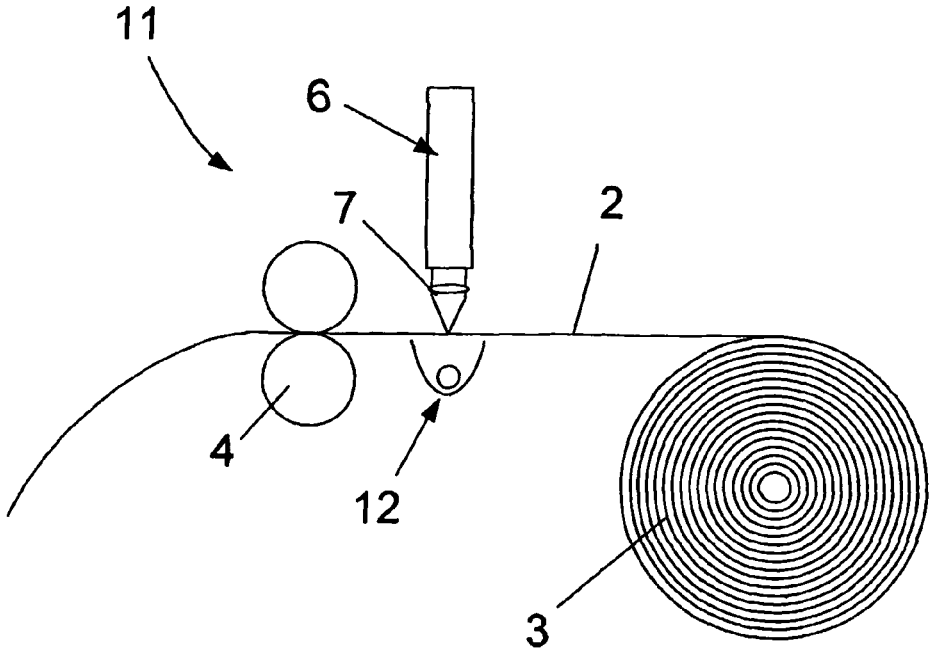
FIG. 3 is a further schematic representation in side elevation of a laser marking system in accordance with a third embodiment of the invention.

Identical components have preserved identical references in FIG. 3 which shows a laser marking system generally referenced 11. If the marking mechanism is photo-chemical in nature, the pre-heating concept described with reference to either preceding figures may be used to enhance or speed up the reaction. An alternative method for use with photo-chemical reactions is to utilise optical biasing where a bright uniform light source such as that shown and referenced 12 in FIG. 3 is used to illuminate the paper substrate to add a base level of light required to achieve the optical density just below the marking threshold. The laser array is shown to be emitting light on the paper at the same position as the bright uniform light source. This additional light source may be selected by the person skilled in the art to be, for example, a discharge lamp or a laser as convenient.

Any non-linear nature of the paper also offers the opportunity of reducing the paper threshold. The energy required to mark the paper is dependent on the time over which that energy is applied. The non-linearity may be optical or thermal in origin. One example of thermal non-linearity would be in the conduction over time of heat away from the spot on the paper on which the laser is incident. One example of optical non-linearity would be in the absorption of photons over time. The system envisages the incorporation of control means which will allow many adjustments to be made to fine tune its operation with respect to these kinds of non-linearity. The person skilled in the art may also select for example the use of specific papers to address specific non-linearities—for example he/she may select a paper with relatively low thermal conductivity in the case of thermal non-linearity.

The key limitation on the optical output power of the laser array is the thermal load that it generates which requires removing the heat from the laser which can be achieved by passive or optionally active cooling means. One preferred approach is to provide control means which switch the laser on at a high power but for a short limited time. In this manner the thermal load remains the same on the laser but the paper is unable to conduct the incident heat away as quickly, hence creating more efficient marking.

Furthermore, a method to still achieve the speed of the print with higher threshold paper is to provide the system with means which increase the spacing between the marked points on the paper. For example, printing at a pitch of 100 microns but only marking with a laser spot size of 50 microns. If the paper is selected to be highly thermally-insulating, this will result in spaces between the marks and a reduced opacity of the print. This may be acceptable for some applications, eg. receipt printing.

The invention also envisages means for varying the energy supplied to each point of the substrate by varying the pulse and/or amplitude of the transmitted light so that a scale of mark's pigmentation may be achieved. By employing pulse duration or amplitude modulation, the present system may be particularly suited for grey-scale marking.

The invention also envisages, although the cost of such technology is still considerable, the use of specialized semiconductor heat pumps such as Peltier coolers adapted to act as a heat exchanger between the laser array and a section of the paper substrate up stream from the laser array.

Whilst the first two embodiments present the use of a heater to supplement thermal energy prior to the substrate being submitted to the laser array and the third embodiment presents the use of a laser array in conjunction with an optical biasing light source, the system may optionally to be configured as a hybrid of both these embodiments where the substrate is pre-heated and radiated by a biasing light source in addition to the radiation from the laser array.

The invention claimed is:

1. A laser marking system configured to mark paper, the system comprising:

a laser light emitting source;

means for displacing said paper relative to said laser light emitting source, wherein the displacing means is configured to expose a surface of the paper to light from the laser light emitting source, and the exposed surface is sufficiently sensitive to light from the laser light emitting source that, when exposed, energy is absorbed at least one point of said paper; whereby a reaction occurs which changes the color of the exposed surface and said paper is the printed product of said laser marking system; and means for transmitting light from said laser light emitting source to the exposed surface, wherein said laser light emitting source comprises an array of individually addressable lasers arranged for simultaneous marking of a plurality of distinct points of said exposed surface, and said array of lasers comprise semiconductor laser diodes configured to emit light in at least one of the infra red and near infra red spectrums, said paper being sensitive to light of at least one of the infra red and near infra red spectrums, whereby said paper is colored primarily by thermal reactions caused by exposure of the plurality of distinct points to the emitted light; and means for modulating at least one of a duration and an amplitude of the emitted light in order to affect the extent of color change.

2. The system of claim 1, further comprising a heater configured to heat said exposed surface to a temperature close to a marking threshold of the exposed surface prior to the exposed surface being exposed to the laser light.

3. The system of claim 2, further comprising drive electronics and a heat exchanger, wherein at least one of said array of lasers and said drive electronics generates heat and said heat exchanger transfers the heat generated to the exposed surface.

4. The system of claim 2, wherein the heater comprises a light emitter.

5. The system of claim 2, wherein said heater is a preheating bar covering the width of the paper.

6. The system of claim 1, comprising another light emitter positioned adjacent to said laser array and adapted to supply sufficient light so as to bring said paper close to a marking threshold, wherein while said array of lasers emits light, and the exposed surface passes the marking threshold due to the combined effect of said laser array and said other light emitter.

7. The system of claim 6, wherein said light emitter emits light to said exposed surface at a point substantially coincident with the point of light from the laser light emitting source.

8. The system of claim 1, wherein an array of micro lenses is located between said lasers and a plurality of distinct points on said paper.

9. The system of claim 1, wherein at least one optical element is located between said lasers and said paper, said at least one optical element incorporating at least one of a wave guide, a graded-index lens, and a diffractive optical element.

10. The system of claim 1, further comprising a plurality of radiation outputs and means for switching the path of radiation to selected outputs.

11. The system of claim 10, further comprising at least one of a mechanically displaceable optical element, an electronically switchable diffractive element, and a branched wave guide.

12. The system of claim 1, further comprising means for directing the radiation in a plurality of directions.

13. The system of claim 12, further comprising at least one of a mechanically displaceable optical element, an electronically switchable diffractive element, and a branched wave guide.

14. The system of claim 1, wherein each of the array lasers is configured to be pulsed.

15. The system of claim 1, further comprising optical biasing means, comprising a secondary uniform light source which upon actuation shines onto the paper, achieving an optical density just below the marking threshold.

16. The system of claim 15, wherein the optical biasing means further acts to heat the paper prior to marking.

17. A laser marking system configured to mark a paper, the system comprising:

a laser light emitting source;

a moving component configured to displace the paper relative to said laser light emitting source, wherein the moving component is configured to expose a surface of the paper to light from the laser light emitting source, and the exposed surface is sufficiently sensitive to light from the laser light emitting source that, when exposed, energy is absorbed at least one point of said paper; whereby a reaction occurs which changes the color of the exposed surface and said paper is the printed product of said laser marking system;

an optical element configured to transmit light from said laser light emitting source to the exposed surface, wherein said laser light emitting source comprises an array of individually addressable lasers arranged for simultaneous marking of a plurality of distinct points of said exposed surface, and said array of lasers comprises semi-conductor laser diodes configured to emit light in at least one of the infra red and near infra red spectrums, said paper being sensitive to light of at least one of the infra red and near infra red spectrums, whereby said paper is colored primarily by thermal reactions caused by exposure of the plurality of distinct points to the emitted light; and a light modulator configured to modulate at least one of a duration and an amplitude of the emitted light in order to affect the extent of color change.

* * * * *